US006665492B1

(12) United States Patent
Garcia et al.

(10) Patent No.: US 6,665,492 B1
(45) Date of Patent: Dec. 16, 2003

(54) HIGH-VELOCITY ELECTRICALLY HEATED AIR IMPINGEMENT APPARATUS WITH HEATER CONTROL RESPONSIVE TO TWO TEMPERATURE SENSORS

(75) Inventors: Robert Michael Garcia, Aliso Viejo, CA (US); David Bohman Tracy, Lake Charles, LA (US)

(73) Assignee: Northrop Grumman, Los Angeles, CA (US)

( * ) Notice: Subject to any disclaimer, the term of this patent is extended or adjusted under 35 U.S.C. 154(b) by 0 days.

(21) Appl. No.: 08/820,128

(22) Filed: Mar. 19, 1997

(51) Int. Cl.[7] ..... F24H 3/00

(52) U.S. Cl. ..... 392/383; 392/379; 156/499; 219/486

(58) Field of Search ..... 392/379–383, 392/360, 485, 488–489; 34/493–497, 446, 476, 550, 553, 554, 549; 219/494, 486, 487, 400, 388, 480, 477; 165/288, 289, 290; 156/497, 499; 53/370.9, 373.9, 375.9, 377.7

(56) References Cited

U.S. PATENT DOCUMENTS

| | | | | | |
|---|---|---|---|---|---|
| 432,205 | A | * | 7/1890 | McLaughlin | 219/486 |
| 1,313,258 | A | * | 8/1919 | Carmean et al. | 219/486 |
| 1,534,042 | A | * | 4/1925 | Tugendhat | 219/480 |
| 3,324,625 | A | * | 6/1967 | Dulmage | 392/379 |

(List continued on next page.)

FOREIGN PATENT DOCUMENTS

| | | | | |
|---|---|---|---|---|
| AT | 154947 | * | 11/1938 | 392/379 |
| DE | 555068 | * | 7/1932 | 392/379 |
| DE | 2744755 | * | 4/1979 | |
| DE | 29704653 | * | 5/1997 | |
| EP | 648992 | * | 4/1995 | |
| FR | 2541213 | * | 8/1984 | 392/379 |
| GB | 329842 | * | 5/1930 | 392/379 |
| GB | 1361517 | * | 7/1974 | |
| JP | 54-39475 | * | 3/1979 | |
| JP | 59-174316 | * | 10/1984 | |
| JP | 63-278669 | * | 11/1988 | 392/379 |
| JP | 9-115647 | * | 5/1997 | |
| SU | 562433 | * | 6/1977 | 392/379 |

*Primary Examiner*—John A. Jeffery
(74) *Attorney, Agent, or Firm*—Oppenheimer Wolff & Donnelly LLP

(57) ABSTRACT

A high-velocity, accurately responsive impingement heater provides heated air at a substantially constant temperature to a process location to effect control of a process. The heater includes an air line for conducting air from an inlet thereof to the process location. A heat exchanger, including a plurality of electrical heating elements, heats air conducted through the air line. A power driver is connected to the heat exchanger and applies current to the heat exchanger. A controller is connected to the driver and receives a predetermined process temperature input from the user, as required for effecting control of the process. A process temperature sensor is positioned at the process location and measures the temperature of the air provided to the process location. The process temperature sensor provides a process temperature signal to the controller which is indicative of the air temperature at the process location. An internal temperature sensor is positioned immediately downstream from the heat exchanger and measures the temperature of the air at that location in the air line. The internal temperature sensor provides an internal temperature signal to the controller which is indicative of the air temperature downstream from the heat exchanger. Based upon the temperature signals from the temperature sensors, the controller provides a control signal to the driver for specifying the amount of heat required at the process location in order for the heated air to substantially equal the predetermined process temperature. The driver then applies a corresponding current to the heat exchanger in response to the control signal.

16 Claims, 4 Drawing Sheets

U.S. PATENT DOCUMENTS

| | | | | | |
|---|---|---|---|---|---|
| 3,694,625 | A | | 9/1972 | Cole | |
| 4,011,430 | A | * | 3/1977 | Witkin et al. | 219/486 |
| 4,024,378 | A | | 5/1977 | McIntosh | 219/486 |
| 4,147,923 | A | * | 4/1979 | Davis et al. | 392/485 |
| 4,189,093 | A | * | 2/1980 | Schnaibel et al. | 165/289 |
| 4,195,415 | A | * | 4/1980 | Livings et al. | 34/549 |
| 4,286,391 | A | * | 9/1981 | Gerry | 34/543 |
| 4,302,663 | A | | 11/1981 | Chesnut et al. | 219/497 |
| 4,405,855 | A | | 9/1983 | Kolle et al. | 219/501 |
| 4,447,712 | A | | 5/1984 | Covillion | 219/486 |
| 4,510,369 | A | * | 4/1985 | Harrison | 219/386 |
| 4,559,441 | A | | 12/1985 | Rudich, Jr. et al. | 219/364 |
| 4,625,096 | A | | 11/1986 | Fletcher | 219/331 |
| 4,734,872 | A | * | 3/1988 | Eager et al. | 364/557 |
| 4,812,622 | A | * | 3/1989 | Takeda et al. | 219/400 |
| 4,920,252 | A | | 4/1990 | Yoshino | 219/497 |
| 4,991,377 | A | * | 2/1991 | Marchesini | 53/373.9 |
| 5,019,994 | A | * | 5/1991 | Rainville | 34/484 |
| 5,021,637 | A | * | 6/1991 | Perala et al. | 219/485 |
| 5,123,477 | A | * | 6/1992 | Tyler | 165/267 |
| 5,205,132 | A | * | 4/1993 | Fu | 62/208 |
| 5,207,379 | A | | 5/1993 | Hurmi et al. | 236/9 |
| 5,280,422 | A | | 1/1994 | Moe et al. | 364/140 |
| 5,308,958 | A | | 5/1994 | Gassho | 219/486 |
| 5,367,787 | A | * | 11/1994 | Ikeda et al. | 34/549 |
| 5,394,623 | A | * | 3/1995 | Sewell | 34/544 |
| 5,494,097 | A | * | 2/1996 | Straub et al. | 165/1 |
| 5,671,321 | A | * | 9/1997 | Bagnuolo | 392/379 |
| 5,682,684 | A | * | 11/1997 | Wentzlaff et al. | 34/495 |
| 6,018,614 | A | * | 1/2000 | Garcia et al. | 392/383 |

* cited by examiner

HIGH-VELOCITY ELECTRICALLY HEATED AIR IMPINGEMENT APPARATUS WITH HEATER CONTROL RESPONSIVE TO TWO TEMPERATURE SENSORS

BACKGROUND OF THE INVENTION

1. Field of the Invention

The present invention relates to heaters and, more particularly, to a high-velocity, accurately responsive impingement heater which is able to direct constant-temperature air to a process.

2. Description of Related Art

Heaters are used throughout industry to provide heat to a specific location to carry out a particular process. The location may be a joint between two aircraft parts, and the process may be a curing process of a chemical resin used at the joint. The heat provided by the heater, typically by blown air, is required to carry out or to facilitate the curing process. Many curing processes require very precise temperatures in order to be carried out accurately and with the highest degree of quality and reliability.

This is particularly true when the curing process cures composite materials used on high-performance aircraft. The builders of such aircraft absolutely need to maintain strict control over every aspect of the manufacturing process, including the curing to the composite material, to ensure that the aircraft perform as specified and to ensure the safety of pilots and crew. Other processes may include curing ultra-low-reflectance coatings used in stealthy applications.

One of the difficulties in employing heaters is maintaining control of the temperature or, more specifically, maintaining a constant temperature at the location of the process. Heaters use a heating element to heat air which is then blown through a manifold positioned at the location of the process. The manifold is attached to the heater by an air conduit which allows the manifold to be positioned at the location.

Accordingly, the air passing through the heating element travels some distance before reaching the manifold and being blown out to the location to carry out the process. Thus, the temperature of the heated air immediately downstream of the heating element may not be the same as the temperature of the air being blown out of the manifold. This temperature difference is known as offset temperature. Further, many of the processes may be located at a position which does not allow the heater to be positioned closely so that a relatively long air conduit needs to be employed to position the manifold close to the location at which the process is to be carried out.

In conventional heaters, the heating element is located inside a heat-exchanger enclosure and typically is a coiled stainless-steel air line. This poses a number of problems. For example, the length, the diameter, and the wall thickness of the tubing are critical variables that affect the overall performance of the heater. Accordingly, any variation from heater to heater in any of these dimensions eliminates identical performance between heaters. Therefore, highly strict tolerances need to be maintained, thereby increasing production costs.

Another drawback of conventional heaters is that the heat generated by the heating element radiates both outwardly and inwardly from the tubular heating element. The air rushing through the tube can only remove heat from the inside diameter of the tube. Accordingly, efficiency decreases as the heater cannot make use of the outwardly radiated heat, which heat is wasted and lost through the outer diameter. In addition, many conventional heaters use fans to blow air across open heating elements which is inefficient.

Furthermore, conventional heaters require a highly trained operator to manually control the amount of heat being applied to the cure area. This use of specialized operators is inefficient and results in higher production costs. For example, the temperature controller on a number of conventional heaters is programmable. An engineer can determine offset temperatures required internally to achieve the desired cure temperatures at the process. The engineer can then program this information into the controller, thereby allowing a cure to be accomplished generally with no further operator intervention once the curing process is under way. This process is known as profiling. A drawback of profiling a cure is that it is time consuming and needs to be done every time the process changes for another cure, resulting in lower efficiency and higher costs. In addition, controllers are not sufficiently responsive to temperature fluctuations in the air at the location of the process, resulting in temperature lags and overshoots.

SUMMARY OF THE INVENTION

In view of the foregoing discussion, it is an object of the present invention to provide a high-velocity, accurately responsive impingement heater which mitigates and/or obviates the aforementioned drawbacks of conventional heaters.

It is another object of the invention to provide a high-velocity, accurately responsive impingement heater which provides heated air to a process location and maintains the heated air at a substantially constant process temperature.

These objects as well as other objects, features, and benefits of the present invention are achieved by providing a high-velocity, accurately responsive impingement heater which provides heated air to a process location for effecting a process. The heated air which is provided to the process location is maintained at a substantially constant temperature.

According to one aspect of the present invention, the heater includes an air line for conducting air from an inlet thereof to the process location. A heat exchanger, including a plurality of heating elements, is provided for heating air conducted through the air line. A driver, which is connected to the heat exchanger, receives power from a power supply and applies current to the heat exchanger. A controller is connected to the driver and receives a predetermined process temperature required for effecting the process. The controller also provides the driver with a control signal.

The heater further includes a pair of temperature sensors. A process temperature sensor is positioned at the process location and measures the temperature of the air provided to the process location. The process temperature sensor then provides a process temperature signal to the controller which is indicative of the air temperature at the process location. An internal temperature sensor is positioned immediately downstream from the heat exchanger and measures the temperature of the air at that location in the air line. The internal temperature sensor then provides an internal temperature signal to the controller which is indicative of the air temperature downstream from the heat exchanger.

Based upon the temperature signals from the temperature sensors, the controller provides the control signal to the driver for specifying the amount of heat required at the process location in order for the heated air to substantially equal the predetermined process temperature. The driver then applies a corresponding current to the heat exchanger in response to the control signal.

One of the advantages of the heater of the present invention is that profiling (as described above) is eliminated. Rather than an engineer determining the offset temperatures required for a particular process, the heater of the present invention simply requires an operator to enter the predetermined process temperature; offset temperatures do not need to be calculated, particularly from process to process. Accordingly, the heater according to the present invention is more efficient, economical, and easy to use than conventional heaters.

Another advantage of the heater of the present invention is that temperature lags and overshoots are substantially eliminated. As the internal temperature sensor is positioned immediately downstream from the heat exchanger, the air exiting the heat exchanger is immediately monitored. If any temperature fluctuation occurs, then the controller is able to quickly send a control signal indicative of such fluctuation to the drive to adjust the current applied to the heating elements. Accordingly, the heater is much more responsive to minor fluctuations in air temperature than conventional heaters, resulting in the substantial elimination of temperature lags and overshoots.

According to another aspect of the present invention, the heater may include a plurality of heater switches respectively connected to the plurality of heating elements of the heat exchanger. The heater switches enabling each of the heating elements to be manually energizable. This results in the current being applied by the driver to the energized heating elements of the heat exchanger to be inversely proportional to the number of heating elements manually energized. This manual switching on and off of heating elements allows an operator to select any number of heating elements to heat the air for effecting the process.

According to another aspect of the present, the heater may further include a three-phase transformer connected between the driver and the heat exchanger. The heating elements are preferably serially configured with the transformer so that a specific firing order of the heating elements is effected. In addition, a plurality of mercury-displaced switches may be respectively connected between the plurality of heating elements and the transformer.

The heater of the present invention employs a number of beneficial safety features. For example, according to a further aspect of the invention, the heater has a housing within which the heat exchanger, as well as the other components, is disposed. An emergency temperature sensor may be provided to monitor the temperature of ambient air within the housing. Accordingly, if the temperature within the housing reaches unsafe levels, the emergency temperature sensor may signal an alarm or high-temperature indicator to alert the operator.

The air line of the heater also has a number of advantages. For example, a manifold may be connected to the outlet of the air line for easy positioning near the process location and efficient distribution of heated air. Further, the air line is preferably configured to receive compressed air, rather than fan-driven air, for high-velocity, conduction to the process location, which aids in maintaining the temperature of the heated air while moving through the air line.

Other aspects, features, and advantages of the present invention will become apparent to those skilled in the art from a reading of the following detailed description with reference to the accompanying drawings.

DETAILED DESCRIPTION OF THE PREFERRED EMBODIMENTS

Figure 1:
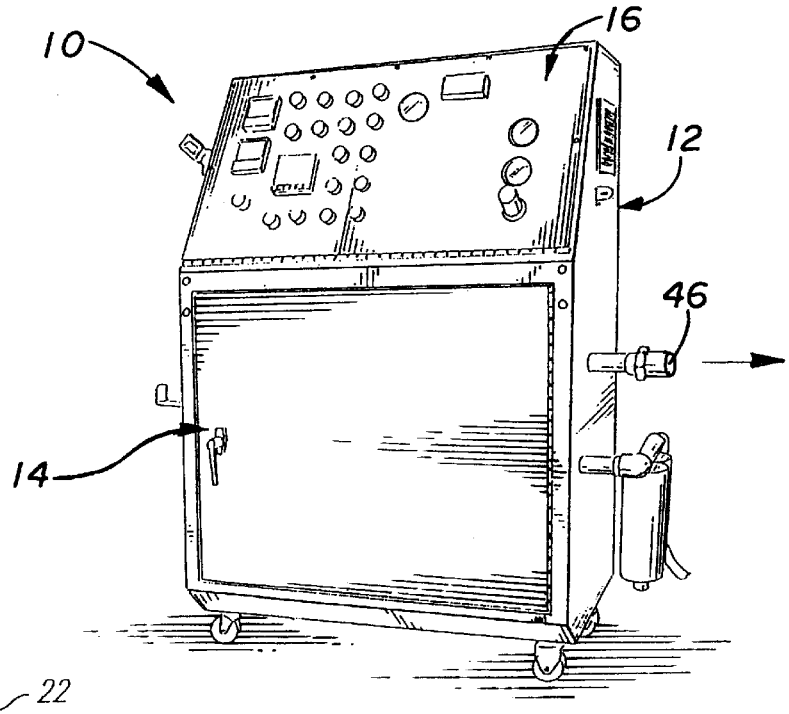
FIG. 1 is a perspective view an exemplary embodiment of a high-velocity, accurately responsive impingement heater implemented in accordance with the present invention.

Referring to the drawings, particularly to FIG. 1, a high-velocity, accurately responsive impingement heater 10 is shown in a preferred embodiment. The heater 10 includes a housing 12 which encloses components of the heater 10, which components may be accessed through a door 14. A control panel 16 is formed on the housing 12 and includes a number of switches, gauges, and indicator lights, which will be discussed in more detail below.

Figure 2:
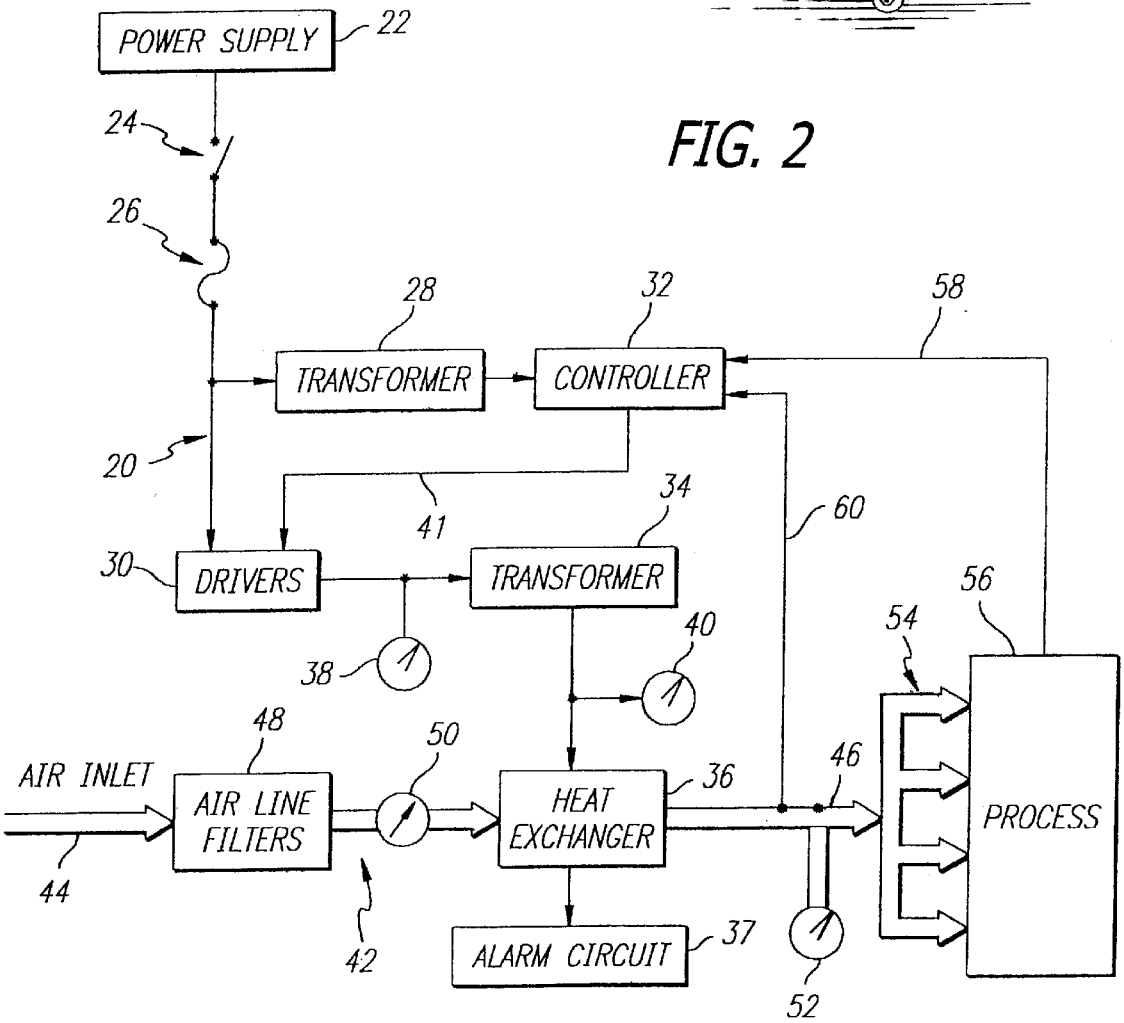
FIG. 2 is a block diagram illustrating the relationship between an electrical control system and an air system of the present invention.

With reference to FIG. 2, the heater 10 includes an electrical control system, shown generally by a single line, and an air system, shown generally by a double line. The electrical control system has a power line 20 connectable to a power supply 22, for example, a 480-volt, 30-amp, three-phase power supply. The power line 20 may include a safety disconnect switch 24 and a plurality of fuses 26, for example, 25-amp or 30-amp fuses, for safety and control purposes.

The power line 20 is connected to a transformer 28 and a driver unit 30. The transformer 28 steps down the voltage of the power line 20 to a voltage which is useable by a controller 32, for example, 115 volts. The output of the driver unit 30 is connected to a second transformer 34 which transforms the power of the power line 20 into a power supply which is useable by a heat exchanger 36. An over-temperature alarm circuit 37 is preferably coupled to the heat exchanger 36. An ammeter 38 may be connected to the input of transformer 34, and a voltmeter 40 may be connected to the output of transformer 34 to monitor these respective parameters. The output of the controller 32 is connected to the driver unit 30, indicated by reference numeral 41, which will be described in more detail below.

The air system of the heater 10 has an air line 42 for conducting compressed air, having an inlet 44 and an outlet 46. The air line 42 is provided downstream of the inlet 44 with a plurality of filters 48 and a regulator 50. An air pressure gage 52 may be provided upstream of the outlet 46 of the air line 42. A manifold 54 is removably attached to the outlet 46 of the air line 42 for directing and providing the heated air to a process 56, for example, a curing process. A temperature-control master feed-back loop 58 is provided from a process temperature sensor 95 positioned at the process location 56 to the controller 32, and a temperature-control slave feed-back loop 60 is provide from an internal temperature sensor 98, downstream of the heat exchanger 36, to the controller 32.

Figure 3:
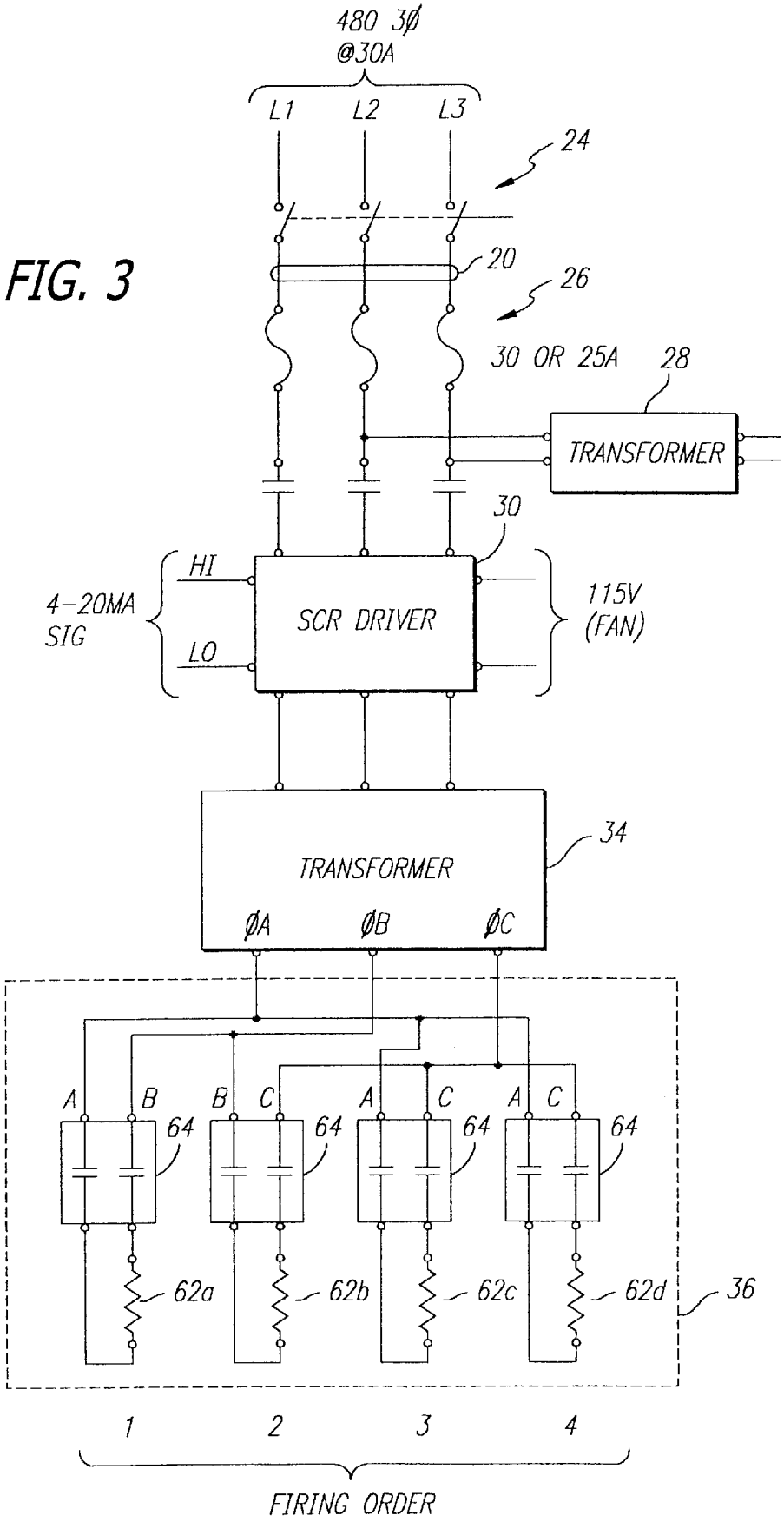
FIG. 3 is a schematic diagram of a preferred embodiment of a power line of the present invention.

With additional reference to FIG. 3, a preferred embodiment of the power line 20 is illustrated. The power supply 20 is preferably 480 volts, three phase, at 30 amps, although other power supplies may be used. The power line 20 includes three lines L1, L2, and L3, each tied in with the safety switch 24 and the fuses 26. The driver unit 30 is preferably a phase-angle silicon-controlled rectifier (SCR) driver. An example of such a driver is model No. G33-480-24-AD1 produced by Watlow Controls of Winona, Minn.

The inputs of the driver unit 30 are respectively coupled to the lines L1–L3 of the power line 20 via capacitors, and the outputs of the driver unit 30 are respectively coupled to transformer 34 for stepping down the 480 volts of the power supply 20 to 240 volts, for example. Two of the lines L2 and L3 are coupled to transformer 28 for stepping down the 480 volts of the power supply 20 to 115 volts, for example.

Transformer 34 has three outputs, each corresponding to one of the three phases of the power supply 20. The heat exchanger 36 includes a plurality of heating elements 62, for example, four, to which each of the outputs of transformer 34 is coupled through a mercury-displaced switch 64. The outputs of transformer 34 are coupled to the heating elements 62 in such a way that a preferable firing order of 1-2-3-4 is effected on heating elements 62*a,* 62*b,* 62*c,* and 62*d,* respectively. Specifically, the phase-A output is coupled to heating elements 62*a,* 62*c,* and 62*d;* the phase-B output is coupled to heating elements 62*a* and 62*b;* and the phase-C output is coupled to heating elements 62*b,* 62*c,* and 62*d.*

The heat exchanger 36 is preferably model No. 007-10137 produced by Convectronics of Methuen,. Mass., with the mercury displace switches 64 preferably model No. KD20-1000-4400 produced by Watlow Controls. In the Convectronics heater exchanger, the heating elements are housed within a ceramic tube which is sleeved within a stainless-steel shroud which, in turn, is placed within a section of stainless-steel pipe for receiving compressed air. Accordingly, compressed air is channeled around the entire heating element for efficient and fast heating. Further, this heat exchanger is also extremely responsive to desired changes in the temperature of the air being heated. Each of the heating elements 62 is preferably rated at up to 6,000 watts, which is controlled by varying the amount of applied current.

Figure 4A:
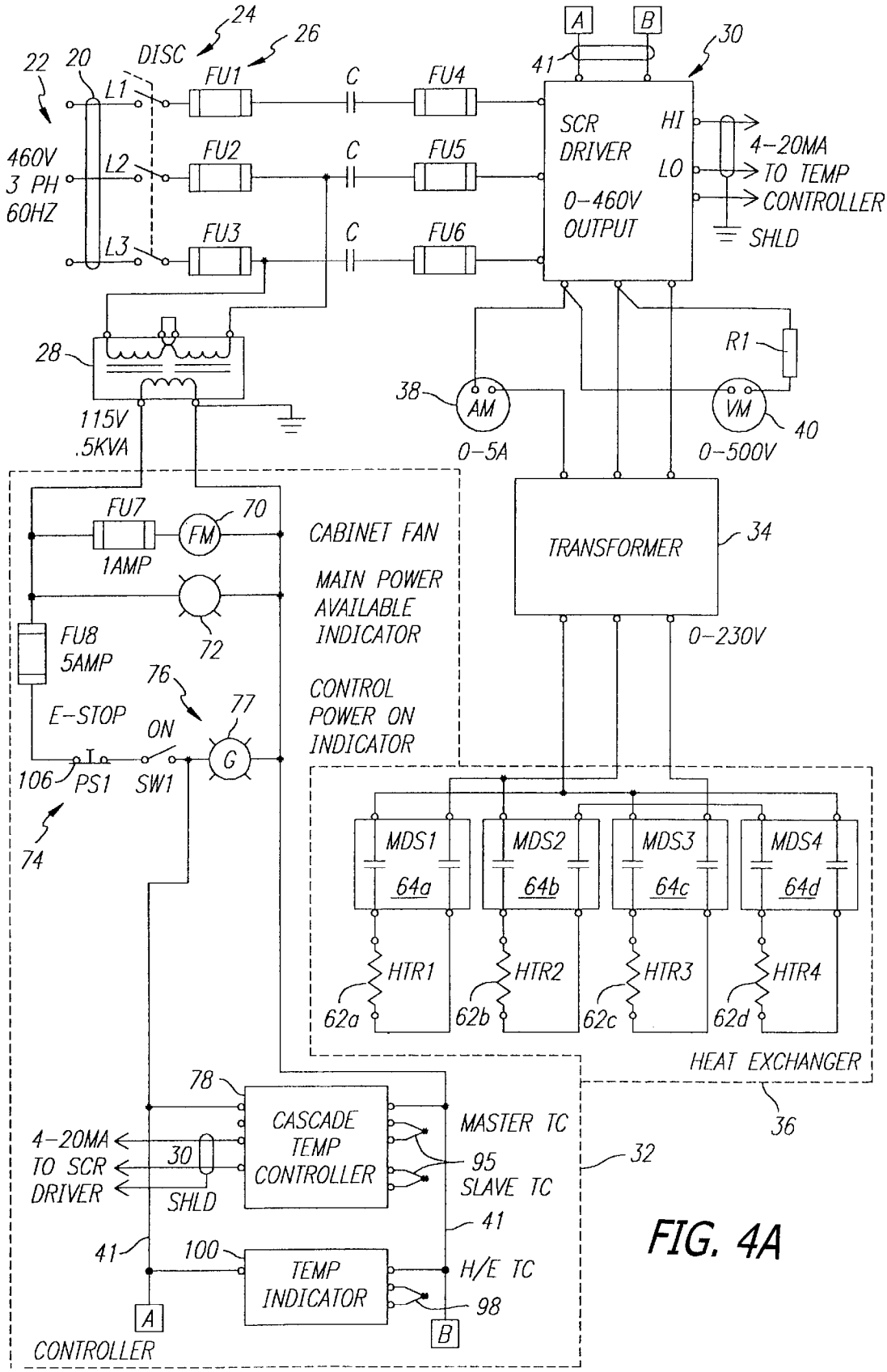
FIGS. 4A and 4B are schematic diagrams of control circuitry in accordance with a preferred embodiment of the present invention, with the circuitry of FIG. 4B connected to the circuitry of FIG. 4A at nodes A and B.
Figure 4B:
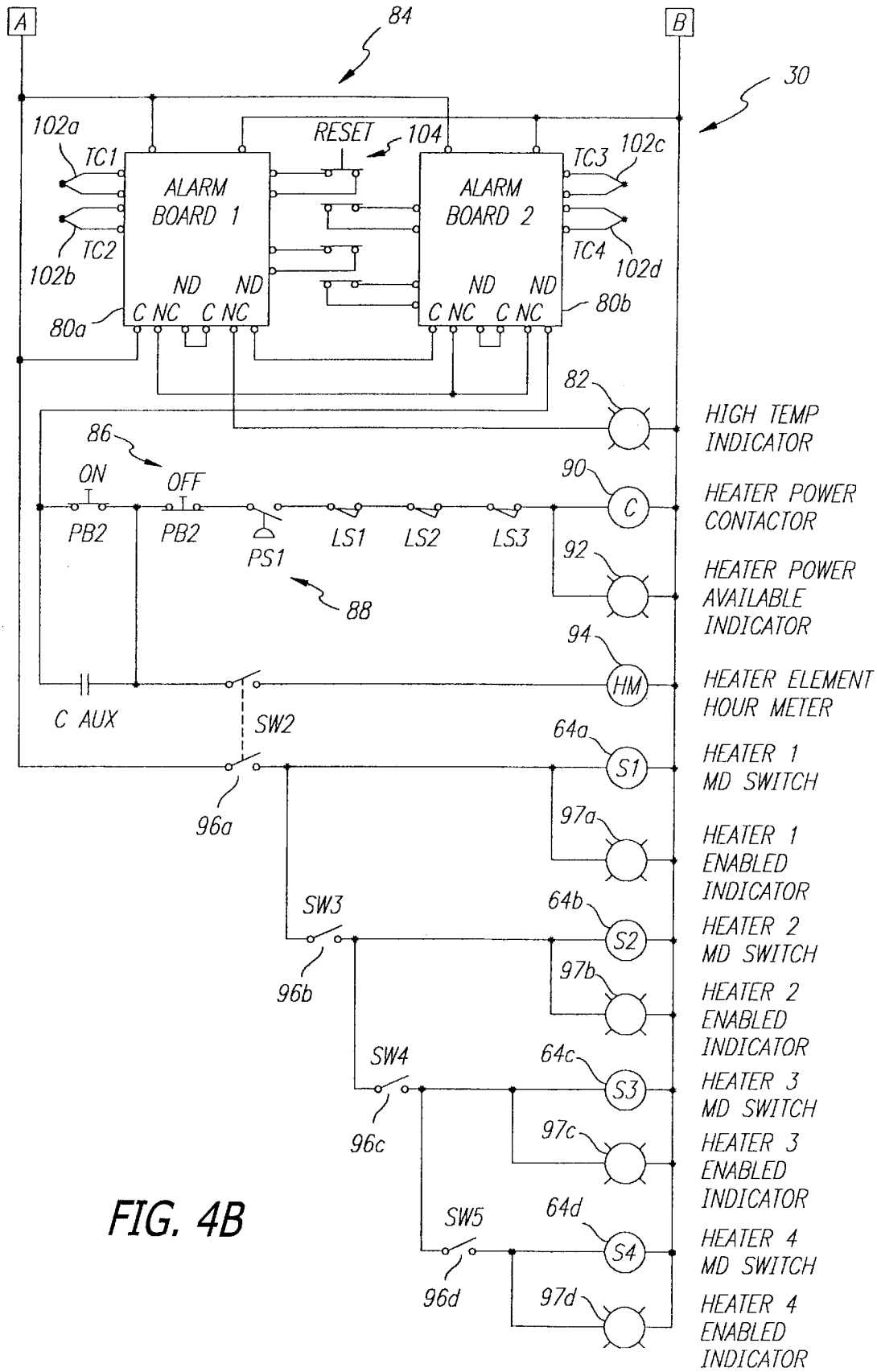

The general operation of the heater 10 will be provided with additional reference to FIGS. 4A and 4B. The heater 10 is positioned near or adjacent to the process 56 such that the manifold 54 optimally directs heated air to the process 56. The power line 20 is connected to the power supply 22 which, as mentioned above, is preferable 460 volts, three phase, at 30 amps. The fused safety disconnect, including switches 24 and fuses 26, receives the power and, once energized, applies line voltage to contactor C and to transformer 28 (which is preferably a 0.5 KVA, 480V–115V step-down transformer). Transformer 28 supplies the control voltage for the heater 10. Power is supplied to a cabinet fan 70 and a main power available indicator 72. Power may also be supplied to an emergency-stop circuit 74 and a control power circuit 76. At this point in the operation, the heater 10 may be considered to be in a "stand-by" mode.

The operator sets the desired temperature on the control panel 16 which is inputted into the controller 32. Alternatively, the operator may program a desired cure or process parameters into the heater 10, with which the controller 32 is able to carry out the process. In any case, the heater 10 is then started by turning on a control-power switch SW1, activating a control-power indicator 77. Control power is supplied to the SCR driver 30, a cascade temperature controller 78, and a first and second alarm boards 80*a* and 80*b.* Upon receiving control power, the cascade temperature controller 78 initiates a start-up sequence, and the SCR driver 30 may activate one or more internal fan motors (not shown).

Control power is also supplied to the first mercury-displaced switch 64*a* (MDS1), thus activating a first heating element 62*a* (HTR1). The mercury-displaced switches 64*a–d* are wired in series so that the first heating element 62*a* (HTR1) needs to be enabled before a second heating element 62*b* (HTR2) is able to be energized, and so on, which will be discussed in more detail below. As shown, there are preferably four heating elements 62*a–d* (HTR1–HTR4). Mercury-displaced switches are preferably used because of their good performance in volatile environments and because of their safe operation from the lack of contacts which eliminates arcing and sparks.

If a high-temperature condition within the heater 10 does not exist, as indicated by a high-temperature indicator 82, relays 84 connected between the alarm boards 80 energize, closing the circuit therebetween and providing power to a heater-power contactor circuit 86. With air pressure being applied to the heater 10, causing compressed air to flow through the heater 10, activating a start switch 88 will energize a heater power contactor 90, thereby applying line voltage to the SCR driver 30 via node B. A heater power available indicator 92 will also be energized, indicating available power for the heaters 62. In addition, a heater-element-hour meter 94 receives power via a switch tied to a first heater switch 96*a* (SW2). At this point in the operation, the heater 10 is ready to generate heat.

Depending upon the temperature required to carry out the process 56, an appropriate number of the heaters 62 are activated. The temperature is entered into the system, and the temperature controller 32 generates an electrical control signal, indicated by reference numeral 41, which is input into and processed by the SCR driver 30. The control signal 41 preferably ranges from about 4 mA to about 20 mA and is indicative of the level of power required to maintain the preferred process temperature. Based on the control signal 41, the SCR driver 30 then applies a voltage, which preferably varies from zero to 450 volts, to stepdown transformer 34. This applied voltage may be monitored on the voltmeter 40 (with current monitored on the ammeter 38). Transformer 34 then applies the stepped down voltage, which may vary from zero to 240 volts, to the heating elements 62.

The controller 32 makes use of the dual-loop configuration of the master feedback loop 58 and the slave feedback loop 60. Each of the feedback loops 58 and 60 includes a thermocouple 95 and 98. The thermocouple 95 of the master feedback loop 58 monitors the temperature at process 56, and the thermocouple 98 of the slave feedback loop 60 monitors the temperature at the output of the heat exchanger 36. The controller 32 mediates the two signals from the thermocouples 98 and correspondingly adjusts and applies the control signal 41 to the SCR driver 30 to specify the amount of heat required at the process 56. Upon receiving the control signal 41, the SCR driver 30 then controls the amount of current applied to the heating elements 62 to produce the amount of required heat. This dual-monitoring process eliminates temperature lags and overshoots commonly associated with conventional devices.

The controller 32 and the feedback loops 58 and 60 are preferably configured such that the controller 32 only uses the signal from the slave feedback 58 in conjunction with the signal from the master feedback loop 60 in determining the control signal 41. For example, if the signal provided by the slave feedback loop 60 indicates that the temperature is changing at the output of the heat exchanger 36 but not at the process 56, the controller 32 will not generate a control signal. However, if the temperature at the output of the heat exchanger 36 is substantially constant but varying at the process 56, then the controller 32 will generate a control signal 41 based on the both the master feedback loop 58 and the slave feedback loop 60.

The heater 10 is configured such that each of the heating elements 62*a–d* may be manually turned on or off as needed while power is being applied by means of a respective heater switch 96*a–d*. Accordingly, the amount of current applied by the SCR driver 30 is proportional to and independent of the number of energized heating elements. For example, if two of the heating elements 62 are energized, the current applied to each of the energized heating elements will be proportionally more than if four of the heating elements 62 were energized. Such a situation results in the two energized heating elements operating more efficiently at a higher current than if four heating elements were energized and operating a low current. This situation is analogous to an automobile engine: a four-cylinder engine operating at high Rpm is more efficient than an eight-cylinder engine operating at low Rpm. Further, operating less heating elements 62 at higher currents substantially eliminates current surging and spikes often associated with operating more heating elements at less current per element.

Each of heating elements 62*a–d* preferably is connected to a respective indicator 97*a–d* which illuminates when the heating element is energized. The internal ambient temperature of the heater 10 may be monitored by a thermocouple 98, for example, a type-J thermocouple, and displayed by a temperature indicator 100 provided on the control panel 16.

As mentioned above, the heating elements 62*a–d* are preferably connected in cascaded series so that subsequent heating elements 62 may be enabled only if the preceding heating element is enabled. Each of the heating elements 62*a–d* may be monitored by a thermocouple 102*a–d* which feeds back into a respective circuit on the alarm boards 80*a* and 80*b*. Accordingly, if an unsafe high-temperature condition exists, the respective alarm board relay 84 will de-energize, thereby opening the heater-power contractor circuit 86, causing line voltage to be removed from the SCR driver 30, and shutting down all heat being generated by the heating elements 62. The high-temperature indicator 82 illuminates to warn an operator of the high-temperature condition. In order for the heater 10 to resume normal operation, the high-temperature condition needs to be resolved, and the system needs to be reset, for example, by a reset switch 104.

An unsafe high-temperature condition may result from a loss in air supplied to the air line 42 or a loss in air pressure within the heater 10. In this case, either the heat exchanger thermocouple 98 or one of the heater thermocouples 102 would trigger a shut down of the system. The air pressure in the air line 42 may be regulated by a remote adjuster located on the control panel 16, which takes pilot air pressure and feeds the in-line regulator 50 of the heater 10. The pressure in the air line 42 at the output of the heat exchanger 36 is monitored by the air gauge 52. A second air gauge may be provided to monitor the air pressure at the input of the heat exchanger 36.

As an additional safety feature of the heater 10 of the present invention, an emergency stop switch or button 106 may be provided which, when activated, terminates all operations of the heater 10, returning the heater to standby mode.

In view of the foregoing, the heater 10 may be configured for the following exemplary process. The manifold 54 may be connected to the outlet 46 of the airline 42 by about 20 feet of piping. The master thermocouple 95 may be positioned within about 2 inches from the orifice of the manifold and within about 4 inches of the location of the process 56. A process temperature of 350° F., for example, may be entered into the controller 32 from the control panel 16. Accordingly, the controller 32, being preconfigured for heat loss from the piping and other variables, energizes the heating elements 62. The temperature immediately downstream from the heat exchanger 36 may need to be maintained at about 150° F. higher than the process temperature, or at 500° F., in order to provide 350° F. air to the process 56. As the temperature stabilizes at the process 56, less power is required to maintain a relatively constant process temperature. The controller 32 generally has a ±5° F. bandwidth and, coupled with the thermocouples 98, is preferably sensitive to at least about 2° F.

The heater 10 may be used to providing air heated up to about 600° F. but is most efficient at providing air heated in the range of about 250° F. to 350° F. The heater 10 may be configured with a higher output heat exchanger 36 and heating elements 62 to yield higher temperatures.

FIG. 5 illustrates an internal view of the housing 12 of the heater 10. The housing 12 encompasses a substantial portion of the electronics used to operate the heater 10, such as the power supply 22, transformer 28, controller 32 and drivers 30. The housing 12 includes the transformer 34 and the elements relating to the generation and sensing of the hot impingement air flow. These elements include the air line filter 48, regulator 50, heat exchanger 36, air pressure gauge 52, internal temperature sensor 98 and emergency temperature sensor 102.

The air line filter 48 is downstream of the air intake pipe 44 protruding out of the heater housing 12, and the outlet pipe 46 is downstream of the air pressure gauge 52. The outlet pipe 46 connects to the removably attached manifold 54, whose end thereof includes the process temperature sensor 95 for sensing the temperature of the process 56. The internal heat sensor 98 is positioned immediately downstream of the heat exchanger to effectively measure the temperature of the air flow thereat. The emergency temperature sensor 102 is positioned within the lower compartment of the housing 14 for monitoring the ambient temperature within the housing 14.

Those skilled in the art will understand that the preceding exemplary embodiments of the present invention provide foundation for numerous alternatives and modifications. For example, the principles of the present invention may be employed with other types of heaters such as gas heaters. These other modifications are also within the scope of the appended claims of the present invention. Accordingly, the present invention is not limited to that precisely shown and described herein.

What is claimed is:

1. A compressed air heating system for applying heated air to a remote process location for effecting a chemical bonding process employed in assembly and repair, comprising:

a heat exchanger having an inlet and an outlet;

an air line for receiving compressed air and applying it to the inlet of said heat exchanger;

an in-line air pressure regulator for adjusting the pressure and velocity of the air which feeds the heat exchanger;

a manifold positionable at the remote process location;

a conduit extending for a substantial distance from the outlet of said heat exchanger to the manifold at the remote process location;

said heat exchanger including a plurality of electrical heating elements;

a driver for receiving power from a power supply and for applying power to the heat exchanger;

a controller connected to the driver for receiving a predetermined process temperature required for effecting the process and for providing the driver with a control signal;

a process temperature sensor positionable at the remote process location for measuring temperature of air provided to the remote process location and for providing a process temperature signal to the controller indicative of the temperature of the air provided to the remote process location; and an internal temperature sensor for measuring temperature of air immediately downstream of the heat exchanger and for providing an internal temperature signal to the controller indicative of the temperature of the air immediately downstream of the heat exchanger;

the controller generating the control signal responsive to the process and internal temperature signals for changing the amount of heat produced by the heat exchanger for maintaining the predetermined process temperature under conditions responsive to air provided to the remote process location deviating from the predetermined process temperature; and an air pressure gauge located at the output of the heat exchanger for monitoring the pressure of the compressed air;

whereby the temperature at the process location may be accurately maintained despite variations in ambient temperature and other factors.

2. The compressed air heating system of claim 1 further comprising a plurality of heater switches respectively connected to the plurality of heating elements of the heat exchanger for enabling each of the heating elements to be manually energizable.

3. The compressed air heating system of claim 1 wherein the control signal specifies an amount of power required to effect a temperature change in order for the heater air provided to the process location to substantially equal the predetermined process temperature.

4. The compressed air heating system of claim 1 further comprising a three-phase transformer connected between the driver and the heat exchanger.

5. The compressed air heating system of claim 4 further comprising a plurality of switches cascaded serially between the plurality of heating elements and the transformer.

6. The compressed air heating system of claim 4 wherein said heating elements further comprise four heating elements and wherein said outputs of said three-phase transformer further comprises phase-A, phase-B, and phase-C outputs such that said phase-A output is coupled to a first, third and fourth heating element, phase-B output is coupled to a first and second heating element, and phase-C output is coupled to a second, third and fourth heating element.

7. The compressed air heating system of claim 1 wherein the driver is a silicon-controlled rectifier.

8. The compressed air heating system of claim 1 wherein each of the temperature sensors is a thermocouple.

9. The compressed air heating system of claim 1 wherein the heated air applied to a process location is up to 600° F.

10. The compressed air heating system of claim 1 where said heat exchanger including a plurality of electrical heating elements are connected in cascaded series such that a selected heating element is enabled only if a preceding heating element is enabled.

11. The compressed air heating system of claim 1 wherein said heating system operates most efficiently between 250° F. to 350° F.

12. A method of providing heat to a remote process location for effecting a chemical bonding process at a substantially constant predetermined process temperature by means of a compressed air heater including a heat exchanger having a plurality of heating elements, a driver, and a controller, the method comprising the steps of:

providing compressed air to a heat exchanger;

monitoring temperature of the air provided to the remote process location;

providing a process temperature signal to the controller indicative of the temperature of the air provided to the remote process location;

monitoring temperature of air immediately downstream of the heat exchanger;

providing a downstream temperature signal to the controller indicative of the temperature of the air downstream of the heat exchanger;

generating a control signal responsive to the process temperature signal and the downstream temperature signal when the temperature of the air provided to the remote process location deviates from the predetermined process temperature by a predetermined amount;

providing the control signal from the controller to the driver;

applying current corresponding to the control signal to the heat exchanger by the driver to compensate for the deviation in the temperature of the air provided to the remote process location wherein said heat exchanger further comprises a plurality of electrical heating elements connected in cascaded series whereby the current supplied energizes said plurality of electrical heating elements such that a selected heating element is enabled only if a preceding heating element is enabled;

providing a manifold at a remote process location coupled to receive heated air from said heat exchanger and for applying this compressed heated air to said remote process location.

13. The method of claim 12 further comprising the step of:

manually energizing a selected number of heating elements so that the current applied to each energized heating element is inversely proportional to the number of energized heating elements.

14. A method for effecting a process at a process location comprising the steps of:

providing the heater of claim 1;

positioning the manifold at the process location;

entering the predetermined process temperature into the controller; and activating the heater.

15. A method for effecting a process at a process location comprising the steps of:

providing a heater of claim 5;

entering the predetermined process temperature into the controller;

activating the heater; and manually switching on at least one of the heating elements.

16. A compressed air heating system for applying heated air to a remote process location for effecting a chemical bonding process employed in assembly and repair, comprising:

a heat exchanger having an inlet and an outlet;

an air line for receiving compressed air and applying it to the inlet of said heat exchanger;

an in-line air pressure regulator for adjusting the pressure and velocity of the air which feeds the heat exchanger;

a manifold positionable at the remote process location;

a conduit extending for a substantial distance from the outlet of said heat exchanger to the manifold at the remote process location;

said heat exchanger including a plurality of electrical heating elements;

a driver for receiving power from a power supply and for applying power to the heat exchanger;

a controller connected to the driver for receiving a predetermined process temperature required for effecting the process and for providing the driver with a control signal;

a process temperature sensor positionable at the remote process location for measuring temperature of air provided to the remote process location and for providing a process temperature signal to the controller indicative of the temperature of the air provided to the remote process location; and an internal temperature sensor for measuring temperature of air immediately downstream of the heat exchanger and for providing an internal temperature signal to the controller indicative of the temperature of the air immediately downstream of the heat exchanger;

the controller generating the control signal responsive to the process and internal temperature signals for changing the amount of heat produced by the heat exchanger for maintaining the predetermined process temperature under conditions responsive to air provided to the remote process location deviating from the predetermined process temperature;

an air pressure gauge located at the output of the heat exchanger for monitoring the pressure of the compressed air;

a housing within which at least the heat exchanger is disposed; and an emergency temperature sensor for monitoring a temperature of ambient air within the housing;

whereby the temperature at the process location may be accurately maintained despite variations in ambient temperature and other factors.

* * * * *